United States Patent [19]

Bakken et al.

[11] 4,021,131

[45] May 3, 1977

[54] COVER ASSEMBLY

[76] Inventors: Kenneth W. Bakken, 20615 Akin Road, Farmington, Minn. 55024; David G. Larson, 8008 67th Ave. N., Minneapolis, Minn. 55428

[22] Filed: Dec. 31, 1975

[21] Appl. No.: 645,877

[52] U.S. Cl. ..... 404/25; 135/6; 220/18

[51] Int. Cl.[2] ..... E02D 29/10

[58] Field of Search ..... 404/26, 25; 49/63, 64, 49/65; 135/6; 52/19, 20, 21, 103, 104; 220/18, 333; 137/371

[56] References Cited

UNITED STATES PATENTS

| | | | |
|---|---|---|---|
| 2,930,387 | 3/1960 | Streich | 135/6 X |
| 3,170,587 | 2/1965 | Beeber | 220/18 |
| 3,384,385 | 5/1968 | Cohen | 220/333 X |

*Primary Examiner*—Nile C. Byers, Jr.
*Attorney, Agent, or Firm*—Burd, Braddock & Bartz

[57] ABSTRACT

A cover assembly for enclosing a utility unit having a housing forming a chamber and having an open bottom. The chamber is of a size to accommodate the utility unit. An articulated connecting structure having two hinges secures the housing to a support, as a base or the ground. The articulated connecting structure permits the housing to be moved from a closed position to an open position to provide access to the utility unit. The housing rests on an annular base supported on the ground. A releasable lock can be provided to hold the housing in a closed position in engagement with the base.

26 Claims, 11 Drawing Figures

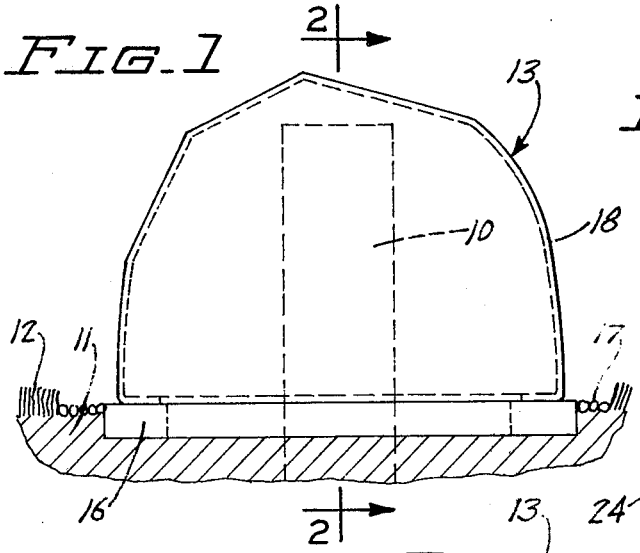
FIG. 1
2
13
10
18
12
11
17
16
2
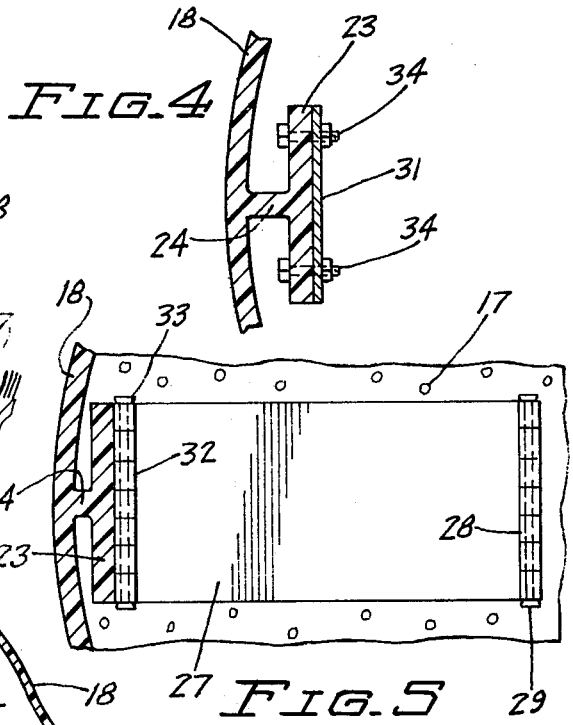
FIG. 4
18
23
34
31
24
34
FIG. 5
18
33
17
32
24
28
23
27
29
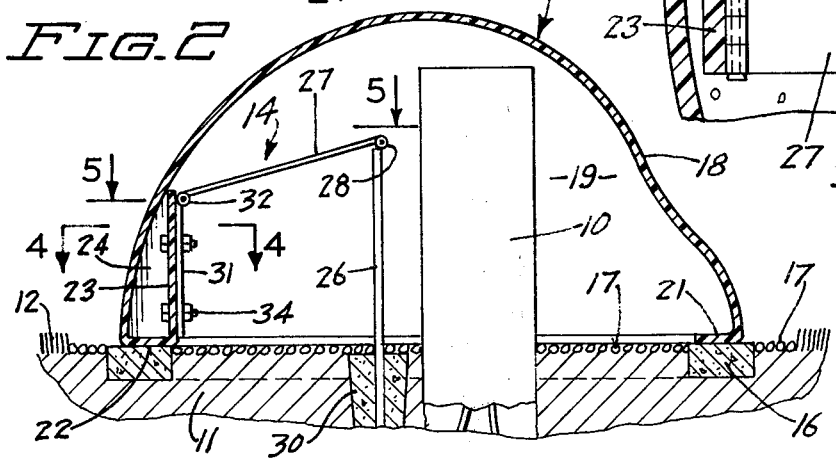
FIG. 2
13
27
5
14
5
28
19
18
32
10
4
24
4
31
26
23
34
17
21
17
12
22
11
30
16
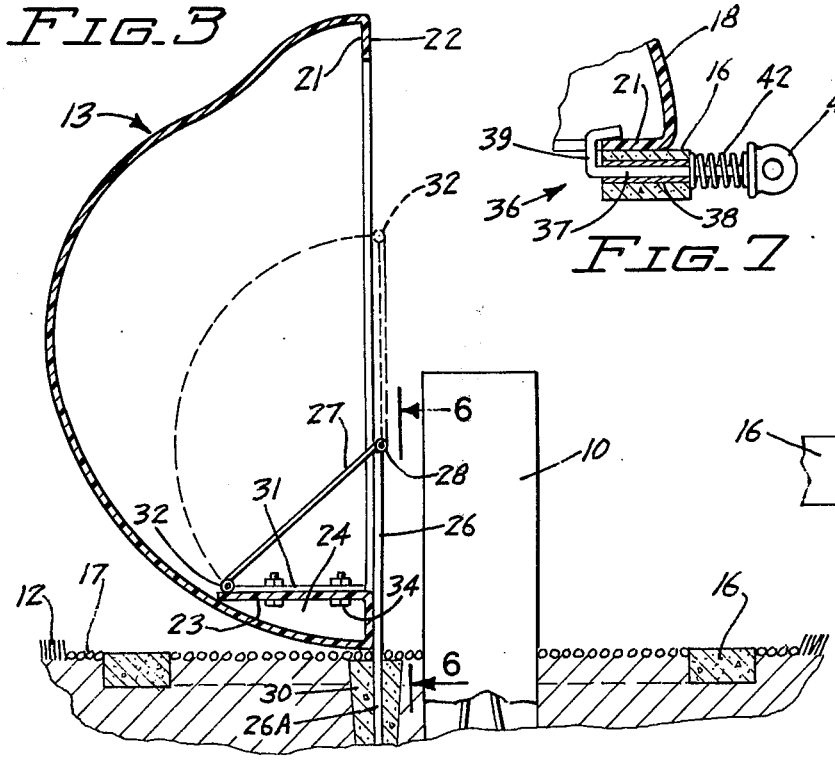
FIG. 3
22
21
13
32
27
6
28
10
31
32
24
26
34
12
17
23
16
6
30
26A
18
21
16
42
41
39
36
37
38
FIG. 7
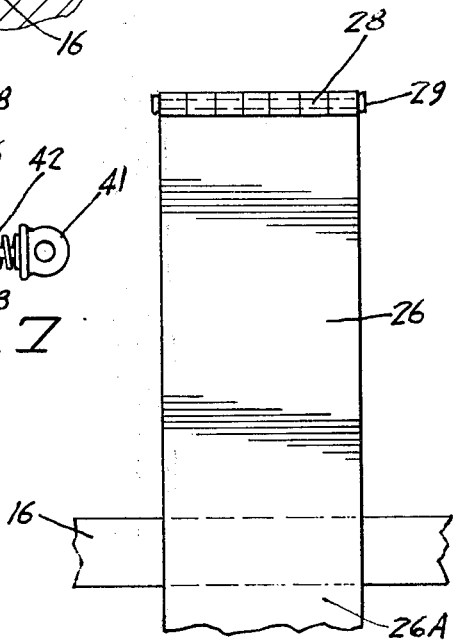
28
29
26
16
26A
FIG. 6

COVER ASSEMBLY

BACKGROUND OF INVENTION

Present day building codes for residential dwellings require that utility lines, as telephone and electric lines, be located underground. Utility service stations project upwardly from the ground to provide access to the underground lines. In some instances, manholes are provided with removable covers to permit access to underground lines. The upwardly projecting utility units and manhole covers are not conducive to an aesthetic landscape surrounding a residence. The utility posts project upwardly from the lawn and the covers present unsightly objects on the lawn. Many landscaping designs utilize rocks of various sizes and foliage to mask the utility units. While the landscaping can overcome some of the aesthetic disadvantages of the utility units, they are not entirely eliminated.

SUMMARY OF INVENTION

The invention is directed to a cover assembly for enclosing an object such as a utility unit or manhole cover. More particularly, the invention is directed to a housing having a chamber or cavity for accommodating a utility unit or manhole cover and simulates the texture and shape of a natural stone or rock. An articulated connecting structure secures the housing to a fixed support, such as the ground or an anchor in the ground. The articulated connecting structure has a pair of hinges and a link which permits the housing to pivot about separate axes so that the size of the cover can have a minimum of variance from the size of the utility unit and still allow the cover to be moved from a closed position to an open position. The housing has an inwardly directed flange which can rest directly on the ground or on a support base, as a concrete support in the ground. A releasable lock may be provided to hold the housing in a closed position.

An object of the invention is to provide a cover assembly that simulates the texture and shape of a natural stone or rock to disguise utility service units and thereby enhance the aesthetic environment of landscaping around a residence. A second object of the invention is to provide a housing for enclosing an object with an articulated connecting structure which permits the housing to be placed over relatively high objects with a minimum sized housing. A further object of the invention is to provide climatic protection for the utility service unit. Another object of the invention is to provide a cover for a utility unit that is aesthetically compatible with landscaping, safe in use, and provides access to the utility unit without disassembling the cover. Yet another object of the invention is to provide a cover assembly for a utility unit that has a natural appearance, long life, is relatively low cost and does not require maintenance or repair over a considerable period of time. These and other advantages of the cover assembly of the invention are readily apparent from the following description of preferred embodiments of the cover assembly.

IN THE DRAWINGS

FIG. 1 is a front elevational view of the cover assembly of the invention located over a utility unit;

FIG. 2 is a sectional view taken along line 2—2 of FIG. 1 showing the cover assembly in the closed position;

FIG. 3 is a sectional view similar to FIG. 2 showing the cover assembly in the open position;

FIG. 4 is an enlarged sectional view taken along line 4—4 of FIG. 2;

FIG. 5 is an enlarged sectional view taken along line 5—5 of FIG. 2;

FIG. 6 is an enlarged sectional view taken along line 6—6 of FIG. 3;

FIG. 7 is a sectional view of a latch holding the housing in a closed position;

DESCRIPTION OF PREFERRED EMBODIMENTS

Figure 8:
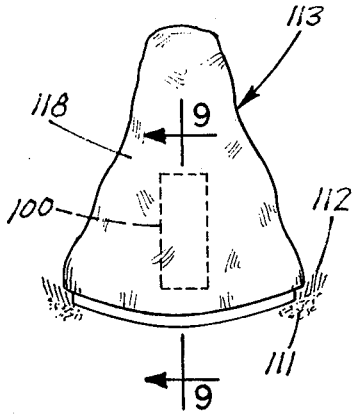
FIG. 8 is an elevational view of a modification of the cover assembly of the invention.

Referring to FIG. 1, there is shown a generally upright utility or service post 10 having a lower end extended into the ground 11. The utility unit 10 is part of the underground wiring system for residential telephone or an electric utility post. Unit 10 can be any object extended upward from the ground including, but not limited to, telephone service posts, electric service outlets, natural gas service outlets, water stand pipes, meter boxes, pumping stations, wells, and the like. The following description is directed to a telephone utility unit 10 that is commonly found on a lawn having grass 12.

The utility unit 10 is located within a cover assembly indicated generally at 13. A hinge structure 14 connected to cover assembly 13 functions to control the pivoting movement of the cover assembly from a closed position, as shown in FIG. 2, as shown in FIG. 3, and anchor the cover assembly to the ground 11. When the cover assembly 13 is in the open position, there is free access to the utility unit 10.

A supporting base 16 in the form of an annular ring of concrete or similar material surrounds the utility unit 10 and is engaged by the lower portion of the cover assembly 13. Preferably, base 16 is a concrete support that is located in the ground 11. A bed of gravel, sand or similar aggregate material 17 surrounds the outside of the base 16 to separate the grass 12 from the base. The aggregate material 17 is also located on the ground within base 16. The aggregate material 17 can be omitted.

The cover assembly 13 comprises a one-piece housing or shell 18 enclosing a chamber 19. The bottom of housing 18 is open and has an inwardly directed continuous flange 21. The lower or bottom surface 22 of flange 21 is flat and adapted to rest on the top side of base 16. Flange 21 can be at an angle to the horizontal or irregularly shaped to conform to the surface of the ground or base. A flat, generally upright support is located adjacent one side of the housing. An upright rib 24 is integral with housing 18 and support 23. The lower ends of support 23 and rib 24 are integral with flange 21. The housing 18 is preferably a molded plastic construction of polyethylene or polyurethane reinforced with glass fibers or fibrous cloth. Other types of rigid construction materials can be used to make housing 18. The outside surface of housing 18 has an appearance which simulates natural rock or stone, such as granite, quartz, sandstone, limestone, or the like. The plastic material may incorporate sand, fine silica, tailings, or the like.

One method of making housing 18 is to provide a mold having a cavity which corresponds to the outside shape of the housing and an inward flange. The uncured plastic material is sprayed into the mold. During spraying of the plastic material into the mold, short strands of glass fibers and solid particles are incorporated into the plastic material. After a layer of suitable thickness is applied to the mold, the mold is subjected to heat to cure the plastic.

In another process, a generally flat sheet of acrylic material is heated over a vacuum-type mold. A vacuum force is applied to the mold cavity to evacuate air from the cavity. The heated plastic sheet is drawn into the cavity and conforms to the shape of the cavity. The mold is then allowed to cool to set the plastic sheet. The housing is then removed from the mold.

The hinge structure 14 is an articulated connecting structure which includes a generally upright post or support 26 having a lower end 26A anchored into the ground 11. End 26A extends into an anchor or block 30, as concrete, located in the ground 11. Post 26 can be secured to base ring 16 so that the ring will support the post in a generally upright position. As shown in FIG. 6, post 26 is a flat plate member having an upper end located adjacent the utility unit 10. A flat link 27 extends away from post 26. A hinge 28 having a transverse pivot pin 29 pivotally connects adjacent ends of the post 26 and link 27. The link 27 extends to an upright plate 31. A transverse hinge 32 having a pin 33 pivotally joins the upper end of plate 31 to link 27. As shown in FIG. 4, a plurality of bolts 34 secure plate 31 to the support 23.

In use, the hinge structure 14 anchors or secures the cover assembly 13 to the ground and locates the cover assembly in alignment with the base 16. The hinge structure 14 also allows housing 18 to be moved to an open position, as shown in FIG. 3. Housing 18 is free to pivot about either or both pins 29 and 33. When the housing 18 is in the open position, the lower part of flange 22 engages post 26 and thereby holds the housing in a generally upright position, as shown in FIG. 3. The weight of the housing, being over center from hinge 28, will keep the housing in the open position. The housing is closed by moving the upper end downwardly toward base 16. The housing 18 can move about pivot 28 whereby the elevation of the housing is raised, as shown by the broken lines, thereby permitting the housing to fit over a relatively high utility unit without increasing the size or length of the housing. The housing is lowered over the utility unit by concurrent pivoting of the housing about the hinges 28 and 32 until the housing is in the closed position, as shown in FIG. 2.

Referring to FIG. 7, there is shown a locking assembly indicated generally at 36 that can be used to lock the cover assembly 13 in the closed position. Locking assembly 36 includes a generally horizontal rod 37 movably mounted in a sleeve 38. Sleeve 38 is located in the base 16. A hook end 39 attached to rod 37 has a portion that extends over the flange 21 to thereby hold the housing 18 in engagement with base 16. The outer end of rod 37 is attached to a head 41. A spring 42 located between head 41 and base 16 biases the hook end 39 in a locked position. The lock assembly 36 is released by pushing head 41 toward base 16, thereby releasing the hook end from the flange 21. Other types of lock structures can be used to secure the cover the cover assembly 13 in the closed position.

Figure 9:
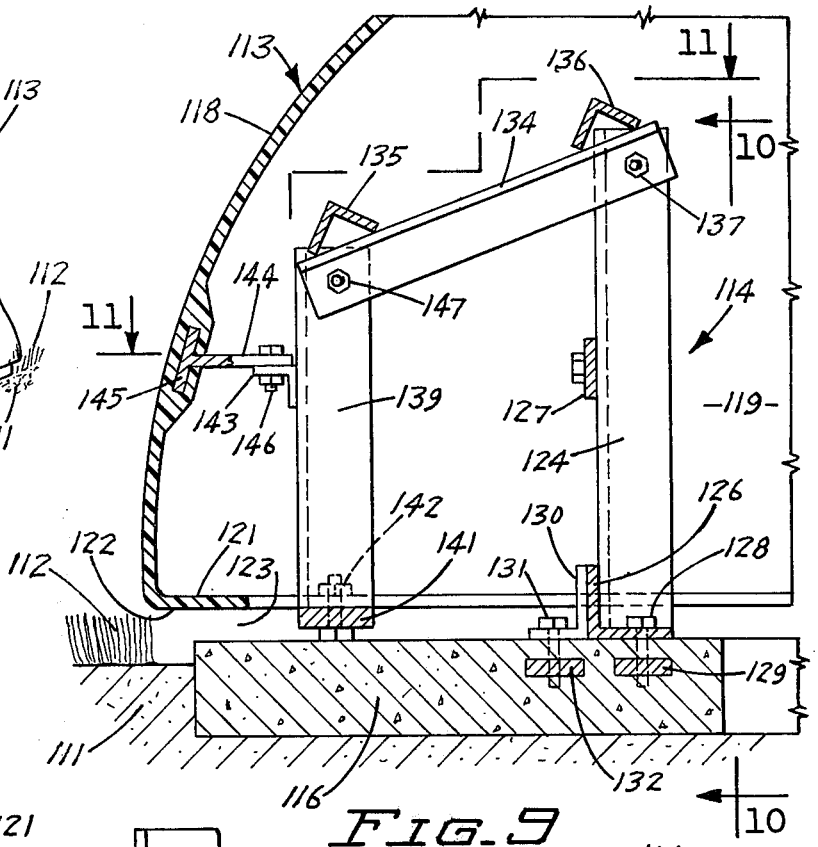
FIG. 9 is an enlarged sectional view taken along line 9—9 of FIG. 8.
Figure 11:
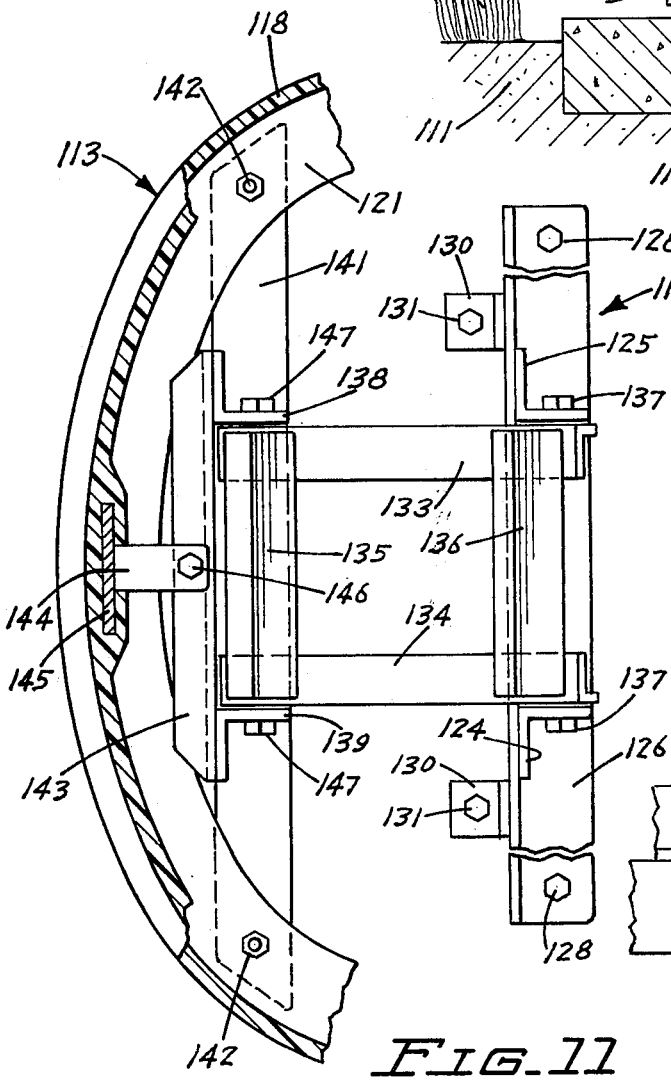
FIG. 11 is a sectional view taken along line 11—11 of FIG. 9.
Figure 10:
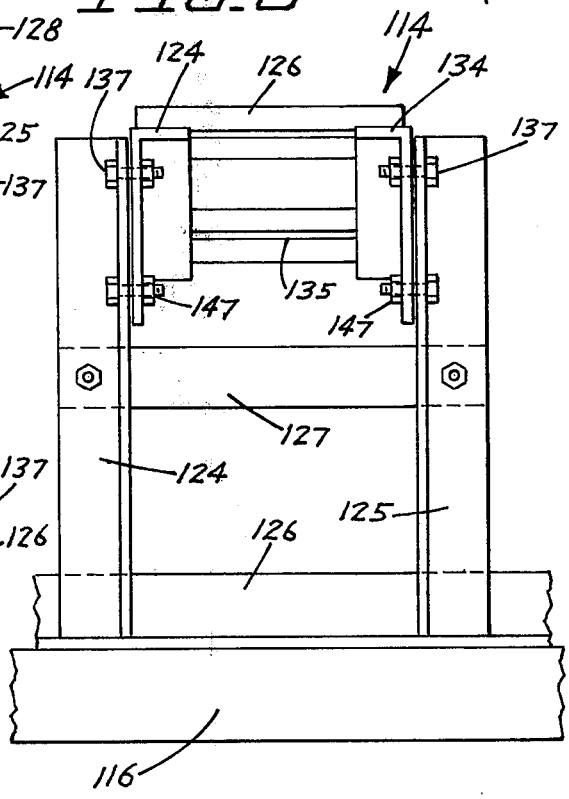
FIG. 10 is a sectional view taken along line 10—10 of FIG. 9.

Referring to FIGS. 8–11, there is shown a modification of the cover assembly of the invention indicated generally at 113. The cover assembly 113 is secured to a base structure 116, as a concrete platform located on the ground 111 or lawn 112. The base 116 has a central hole for accommodating the upright utility post 100 shown in FIG. 8. The cover assembly 113 is used to enclose the utility unit 100.

Cover assembly 113 has a housing or inverted hollow shell 118 forming an interior chamber 119. The bottom of the chamber is open and surrounded by an inwardly directed flange 121. Flange 121 has a generally flat bottom surface 122. Surface 122 is spaced above the top surface of the base 116 to provide a ventilating space 123 for chamber 119. The shell 118 can be of the same construction as housing 18 shown in FIGS. 1–7.

The shell 118 is articulately connected to the base 116 with a hinge structure indicated generally at 114. The hinge structure has a pair of upright posts 124 and 125 connected to a transverse base 126. The midsections of posts 124 and 125 are connected to a reinforcing cross member 127. A pair of bolts 128 secure the base 126 to anchors 129 embedded in base 116. A pair of tabs 130 are secured to the back of base 126. Bolts 131 secure the tabs to anchors 132 embedded in the support base 116.

Pivotally mounted to the top of posts 124 and 125 is a pair of links 133 and 134. Links 133 and 134 are connected at their opposite ends with cross members 135 and 136. Pivot bolts 137 pivotally connect the ends of links 133 and 134 to the top of posts 124 and 125, respectively. A pair of upright supports 138 and 139, as legs or posts, are located adjacent the rear ends of the links 133 and 134. The bottoms of the supports 138 and 139 are secured to a cross member or base plate 141. Bolts 142 secure the ends of the base plate 141 to the flange 121. The supports 138 and 139 are also connected with a cross member 143. An arm 144 having a head 145 embedded in the shell 118 is secured to the middle of cross member 143 with a fastener 146, such as a nut and bolt assembly. A pivot bolt 147 pivotally connects the upper ends of the supports 138 and 139 to the rear ends of links 133 and 134. The pivotal axes of the bolts 137 and 147 are laterally spaced from each other and are parallel to each other so that shell 118 can pivot about the separate axes of the bolts 137 and 147 to an open position similar to the position of shell 18 shown in FIG. 3.

The structural members of the hinge structure 114 are shown as right angle members. The members could be tubular or square.

In use, the supporting base or concrete platform 116 is placed about the utility unit 110 and in ground 111. The hinge structure 114 is connected to the shell 118 by attaching the base plate 141 to the flange 121 with bolts 142. Arm 144 is attached to cross member 143 which bolt 146. The shell 118 and the hinge structure 114 are then placed on the support base 116. Bolts 128 and 131 secure the transverse base member 126 to the support base 116, thereby fixedly mounting the hinge structure 116 to the support base 116. The shell or housing 118 is free to pivot about either or both of the pivot bolts 137 and 147.

When shell 118 is in the open position, the lower part of the flange 121 engages the fixed upright posts 124 and 125 and thereby holds the shell 118 in a generally upright position similar to the position of shell 18 shown in FIG. 3. The weight of the shell 118, being overcenter from the axes of bolts 137, will keep the shell 118 in its open position. The shell 118 is closed by moving the upper end of the shell downwardly toward the support base 116. The shell 118 can move about pivot bolts 147 and thereby elevate links 133 and 134 to permit shell 118 to be elevated so that it can move over a relatively high utility unit without increasing the size or length of the shell. The shell is then lowered downwardly over the high utility unit by concurrently pivoting the shell about the axes of the pivot 137 and 147.

While there have been shown and described preferred embodiments of the invention, it is understood that changes in size, shape, material and structure can be made by those skilled in the art without departing from the invention.

The embodiments of the invention in which an exclusive property or privilege is claimed are defined as follows:

1. A cover assembly for an object located on a support, as the ground, comprising: a base locatable on the support adjacent the object, a housing having a chamber and a lower edge surrounding an open bottom, said lower edge having an inwardly directed flange locatable adjacent the base when the housing is in a closed position wherein the housing covers the object, said chamber being of a size to accommodate the object, and means connected to the housing attaching the housing to the base allowing the housing to be moved from a closed position to an open position wherein the object is exposed to the environment surrounding the housing, said means being located within the chamber and including at least one fixed upright post, means connecting the upright post to the base, a member attached to the housing, a link extended between the post and the member, first pivot means pivotally connecting the link to the member whereby the housing can pivot about two pivot axes when the housing is moved from the closed position to the open position and from the open position to the closed position.

2. The cover assembly of claim 1 wherein: the housing is a shell having a continuous wall surrounding the chamber.

3. The cover assembly of claim 1 wherein: the housing is a one-piece plastic member.

4. The cover assembly of claim 1 wherein: the housing has an outer surface of a shape and texture that simulates natural rock.

5. The cover assembly of claim 1 wherein: the base is a platform having a hole for accommodating the object.

6. The cover assembly of claim 1 wherein: the housing has a support, and said member is a plate attached to the support.

7. The cover assembly of claim 1 wherein: said post has an upper end, said member has an upper end, said first pivot means pivotally connecting a first portion of the link to the upper end of the post, and said second pivot means pivotally connecting a second portion of the link to the upper end of the member, said first pivot means and second pivot means having generally parallel pivot axes.

8. A cover assembly for an object located on a support, as the ground, comprising: a housing having a chamber and an open bottom, said chamber being of a size to accommodate the object and means connected to the housing attaching the housing to the support allowing the housing to be moved from a closed position wherein the housing covers the object to an open position wherein the object is exposed to the environment surrounding the housing, said means including a fixed post, a link, first hinge means connecting the post to the link, a member attached to the housing, and second hinge means connecting the link to the member, said post, link, and member are generally flat plates and the first hinge means is an elongated hinge connecting the upper end of the post to one end of the hinge and the second hinge means is an elongated hinge connecting the upper end of the member to the other end of the link.

9. The cover assembly of claim 8 including: lock means for holding the housing in its closed position.

10. The cover assembly of claim 9 wherein: the lock means includes a member having a hooked end engageable with the housing and biasing means to hold the end in engagement with the housing.

11. The cover assembly of claim 8 in combination with a base located on the support, said base having an upper surface engaged by the housing when the housing is in the closed position.

12. The cover assembly of claim 8 wherein: said housing comprising a shell having a continuous wall surrounding the chamber.

13. The cover assembly of claim 8 wherein: said housing having a continuously inwardly directed flange.

14. The cover assembly of claim 8 wherein: the housing has a support, and said member has a plate attached to the support.

15. The cover assembly of claim 8 wherein: the first and second hinge means each have pivot pins located generally parallel to each other.

16. A cover assembly for an object located on a support, as the ground, comprising: a housing having a chamber and a bottom portion surrounding an open bottom, said chamber being of a size to accommodate the object, a support base located on the support adjacent the object, and hinge means located within the chamber connected to the housing and the support base, said hinge means anchoring the housing to the support base and allowing the housing to be moved from a closed position wherein the housing covers the object to an open position wherein the object is exposed to the environment surrounding the housing and from the open position to the closed position, said base being located adjacent said bottom portion when the housing is in the closed position.

17. The cover assembly of claim 16 wherein: the housing is a shell having a continuous wall surrounding the chamber.

18. The cover assembly of claim 16 wherein: the housing is a one-piece plastic member.

19. The cover assembly of claim 16 wherein: the housing has an outer surface of a shape and texture that simulates natural rock.

20. The cover assembly of claim 16 wherein: the bottom portion of the housing has an inwardly directed flange.

21. The cover assembly of claim 16 wherein: the housing has an inwardly directed flange surrounding the open bottom of the housing, said hinge means locating the flange in a spaced relationship with respect to the top of the support base when the housing is in the closed position.

22. A cover assembly for an object located on a support, as the ground, comprising: a housing having a chamber and an open bottom, said chamber being of a size to accommodate the object, a support base located on the support adjacent the object, and hinge means connected to the housing and the support base, said hinge means anchoring the housing to the support base and allowing the housing to be moved from a closed position wherein the housing covers the object to an open position wherein the object is exposed to the environment surrounding the housing, said hinge means including upright post means, fastening means releasably securing the upright post means to the support base, link means, first pivot means pivotally connecting the upright post means to the link means, an upright support means, fastening means for connecting the upright support means to the housing, and second pivot means pivotally connecting the link means to the upright support means.

23. The cover assembly of claim 22 wherein: the first pivot means and second pivot means are located along spaced parallel axes.

24. The cover assembly of claim 22 wherein: the housing is a shell having a continuous wall surrounding the chamber.

25. The cover assembly of claim 24 wherein: the shell is a one-piece plastic member having a shape and texture that simulates natural rock.

26. The cover assembly of claim 22 wherein: the housing has a lower portion surrounding the open bottom, said lower portion having an inwardly directed flange, said fastening means connecting the upright support means to the housing including a member attached to said flange.

* * * * *